US007600897B2

(12) United States Patent
Tsai

(10) Patent No.: US 7,600,897 B2
(45) Date of Patent: Oct. 13, 2009

(54) LIGHT EMITTING UNIT HAVING LIGHT SOURCE INSIDE A LAMP TUBE WITH CERAMIC FINS

(76) Inventor: Hua-Hsin Tsai, No. 105, Jhongyang Rd., Jioucyong Village, Linnei Township, Yunlin County (TW)

( * ) Notice: Subject to any disclaimer, the term of this patent is extended or adjusted under 35 U.S.C. 154(b) by 212 days.

(21) Appl. No.: 11/850,211

(22) Filed: Sep. 5, 2007

(65) Prior Publication Data

US 2009/0059593 A1 Mar. 5, 2009

(51) Int. Cl.
*F21V 29/02* (2006.01)

(52) U.S. Cl. ..... 362/294; 362/373; 362/263; 362/240; 362/256; 362/249.02

(58) Field of Classification Search ..... 362/240, 362/249.02, 256, 263, 294, 373
See application file for complete search history.

(56) References Cited

U.S. PATENT DOCUMENTS 7,144,140 B2 * 12/2006 Sun et al. ..... 362/373
7,458,706 B1 * 12/2008 Liu et al. ..... 362/373
7,534,015 B2 * 5/2009 Xu et al. ..... 362/373
7,535,030 B2 * 5/2009 Lin ..... 257/99
2009/0059594 A1 * 3/2009 Lin ..... 362/294

* cited by examiner

*Primary Examiner*—Stephen F Husar
*Assistant Examiner*—James W Cranson
(74) *Attorney, Agent, or Firm*—Rosenberg, Klein & Lee

(57) ABSTRACT

The light emitting unit of this invention mainly comprises: a lamp holder made of insulating ceramics with high thermal conductivity; a plurality of heat dissipating fins protruding integrally from the outer end face of the lamp holder; a light-transmissive lamp tube provided on the lamp holder; a light source mounted in the light-transmissive lamp tube; a lampshade having a light reflecting surface in the inner edge being provided on the lamp holder corresponding to the light-transmissive lamp tube; and a light-transmitting element, corresponding to the transmissive lamp tube, provided outside the lampshade. According to this structure, significant illumination effect can be obtained from the entire light emitting device. Moreover, good heat dissipation effect can also be achieved by the lamp holder made of insulating ceramics with high thermal conductivity and the heat dissipating fins formed integrally with the lamp holder, such that the reduced service life, light depreciation and burn-out of the inside light source caused by overheating of the light source can be avoided so as to increase the entire performance in use.

9 Claims, 5 Drawing Sheets

LIGHT EMITTING UNIT HAVING LIGHT SOURCE INSIDE A LAMP TUBE WITH CERAMIC FINS

BACKGROUND OF THE INVENTION

1. Field of the Invention

The present invention relates to a light emitting unit, particularly to a light emitting unit capable of providing necessary light illumination for user, having good heat dissipation effect such that the reduced service life, light depreciation and burn-down of the inside light source caused by overheating can be avoided so as to increase the entire performance in use.

2. Brief Description of the Prior Art

Various lamps and lanterns for illumination have been developed to enhance task performance or to avoid happening of danger when people conduct a variety of activities in the dark or place with poor illumination. Accompanying with the time changing and the progress of science and technology changing in each passing day, light sources used in increasingly diversified lamps and lanterns, including those that have diversified illumination effect and energy saving efficiency, have been appeared on the market.

While each ordinary light source can emit light to reach intended function of illumination, however it is found in practical application that the key issue of research and development on the light source is generally focused on the improvement of brightness. On the other hand, the heat dissipation problem of light source is still out of consideration. Certain quantity of heat generation will be induced in long term use of light source no matter which kind of light source it is. Deficiency in proper design of heat dissipation will bring about negative influence on the service lifetime of the light source. It happens in the case of high power light source that overheating often causes burn-down thereof. Therefore, improvement on the whole structure of light source is highly expected.

In view of the above defects, the inventor of the present invention provides a light emitting unit after devoting to the research and improvement on the existing structure of the light emitting unit based on the abundant R&D and practical manufacturing experience in the relevant field, so that a total solution on the existing structure can be highly expected.

SUMMARY OF THE INVENTION

The light emitting unit of this invention mainly comprises: a lamp holder made of insulating ceramics with high thermal conductivity; a plurality of heat dissipating fins protruding integrally from the outer end face of the lamp holder; a light-transmissive lamp tube provided on the lamp holder; a light source mounted within the light-transmissive lamp tube; a lampshade having a light reflecting surface in the inner edge being provided on the lamp holder with respect to the outer edge of the light-transmissive lamp tube; and a light-transmitting member provided at the outside of the lampshade with respect to the transmissive lamp tube. According to this structure, better illumination effect can be obtained from the entire light emitting unit. Moreover, significant heat dissipation effect can also be achieved by the lamp holder made of insulating ceramics with high thermal conductivity and the heat dissipating fins formed integrally with the lamp holder, such that the reduced service life, light depreciation and burn-down of the inside light source caused by overheating of the light source can be avoided so as to increase the entire performance in use.

BRIEF DESCRIPTION OF THE DRAWINGS

The present invention will be better understood by the detailed description of the following preferred embodiments with reference to the accompanying drawings, in which.

DETAILED DESCRIPTION OF THE PREFERRED EMBODIMENTS

The technical contents of the present invention will become more apparent from the detailed description of the preferred embodiments in conjunction with the accompanying drawings.

Figure 1:
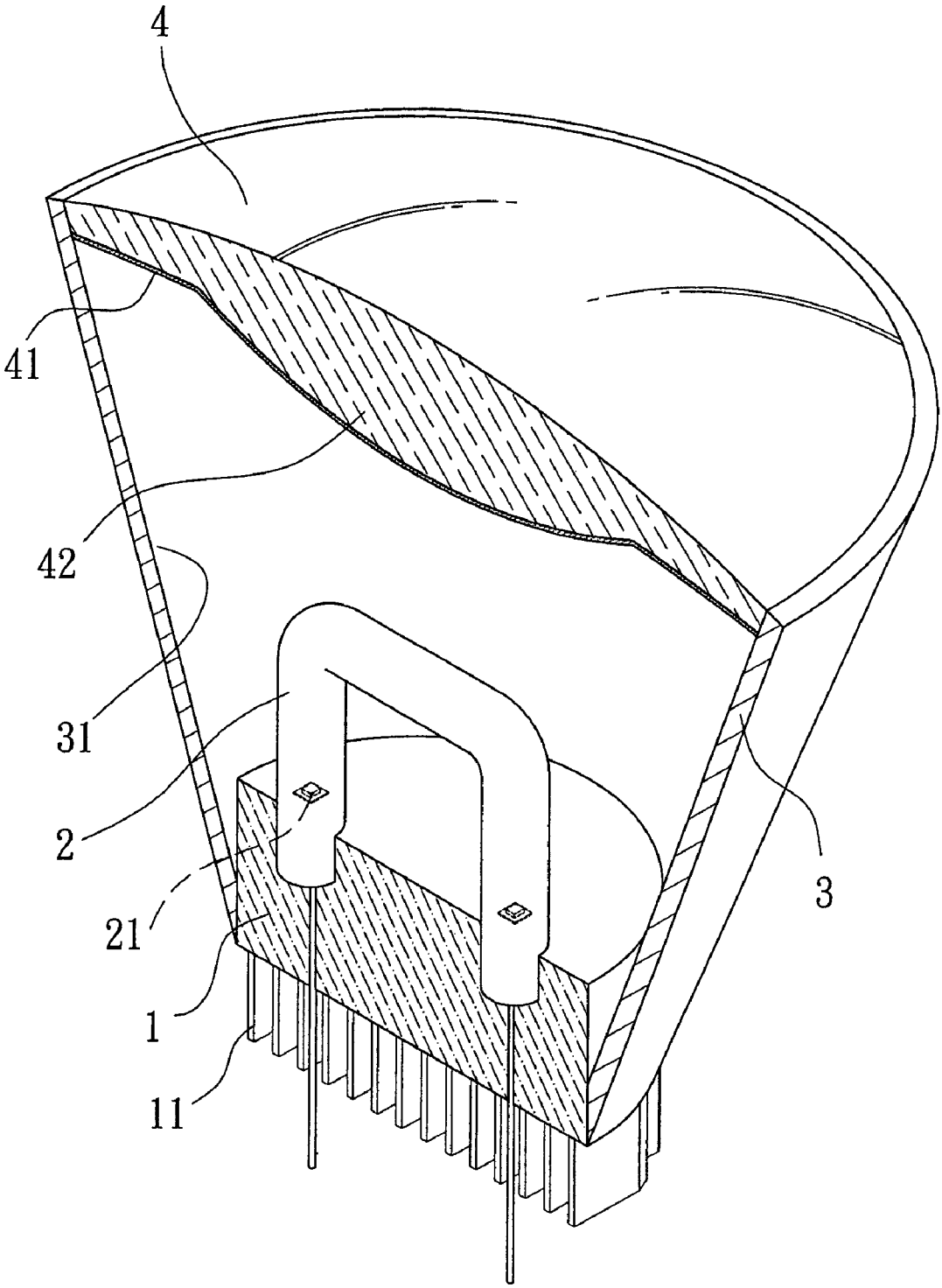
FIG. 1 is a schematic perspective sectional view showing the light emitting unit of the present invention.
Figure 2:
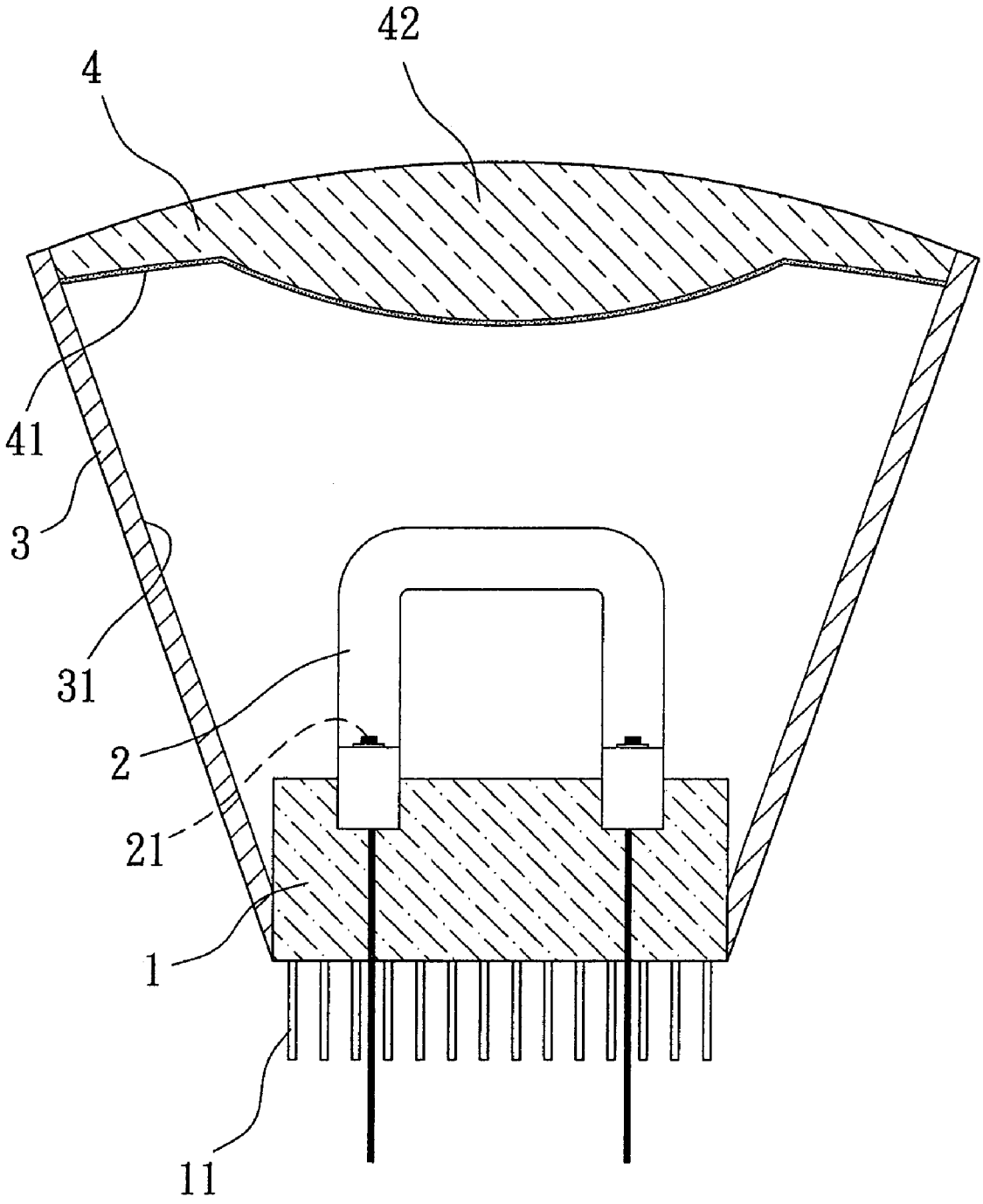
FIG. 2 is a schematic sectional side view showing the light emitting unit of the present invention.

Firstly referring to FIGS. 1 and 2, the light emitting unit of the present invention mainly comprises: a lamp holder (1) made of insulating ceramics with high thermal conductivity; a plurality of heat dissipating fins (11) protruding integrally from the outer end face of the lamp holder (1); a light-transmissive lamp tube (2) provided on the lamp holder (1); a light source (21) mounted in the light-transmissive lamp tube (2), for example a LED or a mercury vapor lamp; a lampshade (3) having a light reflecting surface (31) in the inner edge being provided on the lamp holder with respect to the light-transmissive lamp tube (2); and a light-transmitting member (4) provided at the outer end of the lampshade (3) with respect to the light-transmissive lamp tube (2), which is coated with a fluorescent material (41), and is formed with a convex transmissible surface (42) at the middle position of the light-transmitting member (4).

Figure 3:
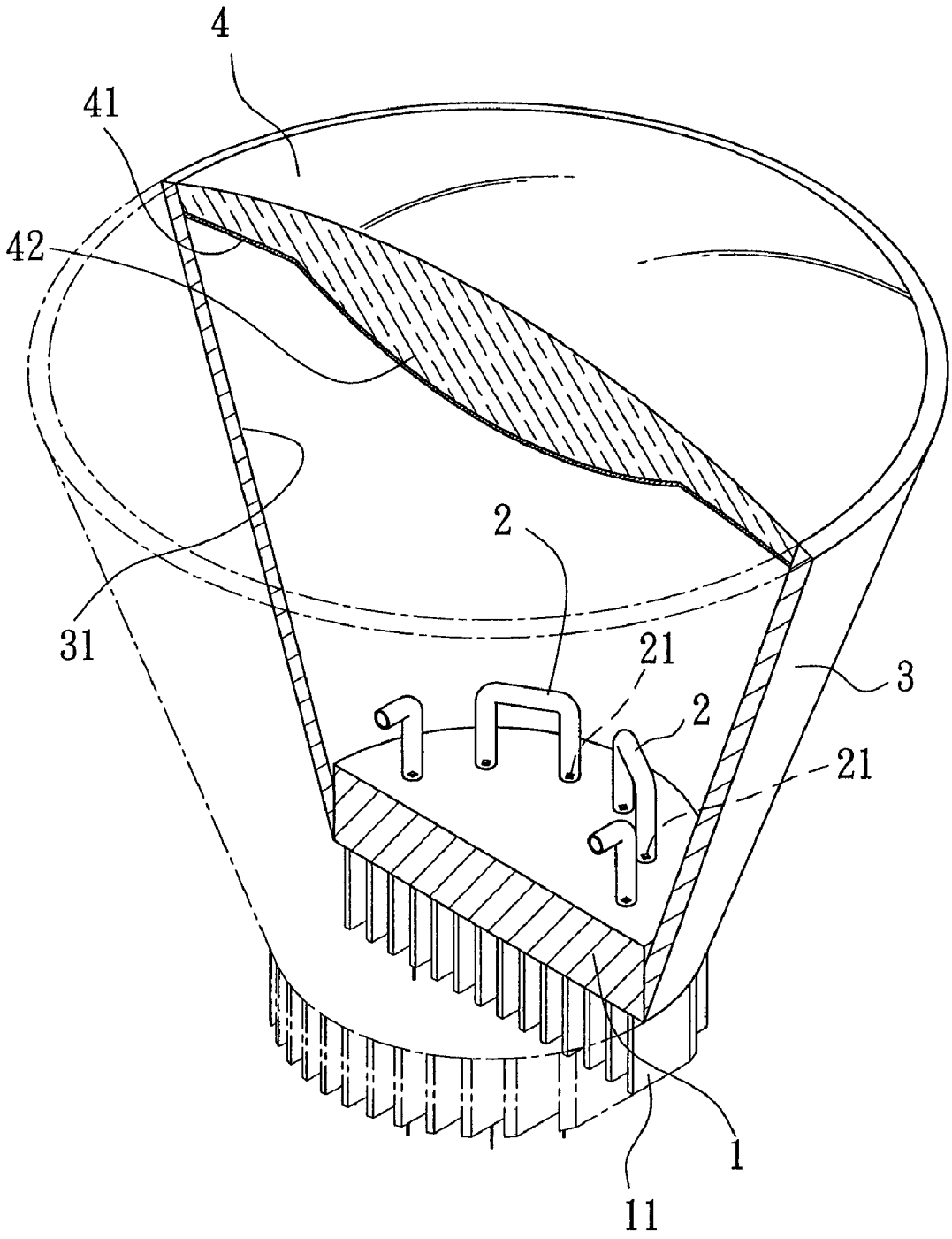
FIG. 3 is a schematic view showing another embodiment of the light emitting unit of the present invention.
Figure 4:
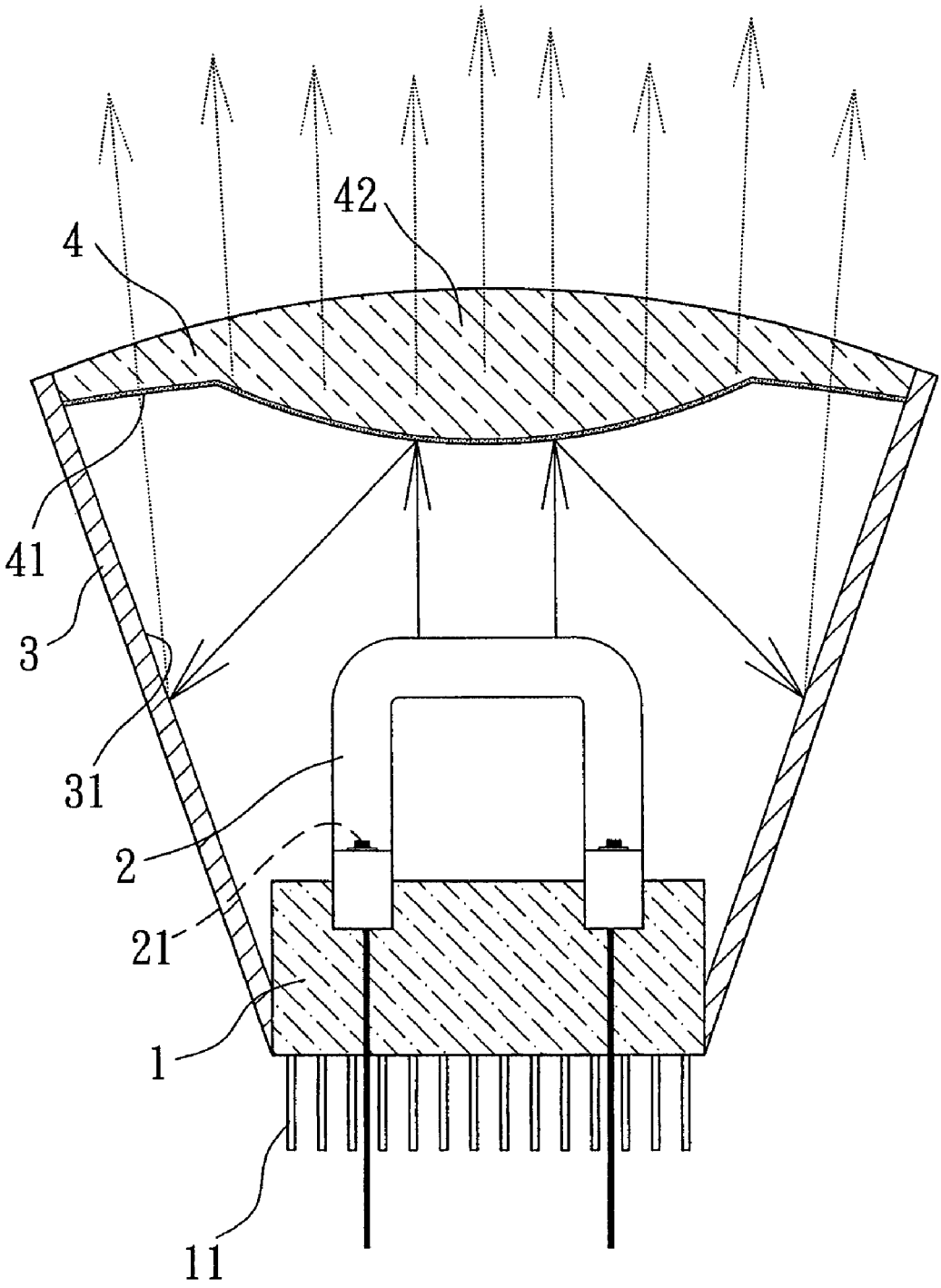
FIG. 4 is a schematic view showing the using state of the present invention.

In addition to the above embodiment in which one set of a light-transmissive lamp tube (2), a light source (21), a lampshade (3) and a light-transmitting member (4) are provided on a lamp holder (1) made of insulating ceramics with high thermal conductivity, another embodiment can be provided to cope with the case of different application as shown in FIG. 3, in which a plurality of light-transmissive lamp tubes (2) and a plurality of corresponding light source (21) are mounted on one lamp holder (1) made of insulating ceramics with high thermal conductivity, then a lampshade (3) is provided on the lamp holder (3) and a light-transmitting member (4) is provided at the outer end of the lampshade (3).

In this manner, the light emitted from the light source (21) within the light-transmissive lamp tube (2) is emitted out towards the light-transmitting member (4) through the light-transmissive lamp tube (2), and is enhanced in brightness by the following two items: the collected reflection of the light impinged on the convex transmissible surface (42) of the light-transmitting member (4) and the light reflecting surface (31) of the lampshade (3); and the fluorescent material (41) coated on the light-transmitting member (4) and its convex transmissible surface (42). The heat generated during the lighting of the light source (21) is dissipated through the lamp holder (1) and the heat dissipating fins (11) both made of insulating ceramics with high thermal conductivity.

Figure 5:
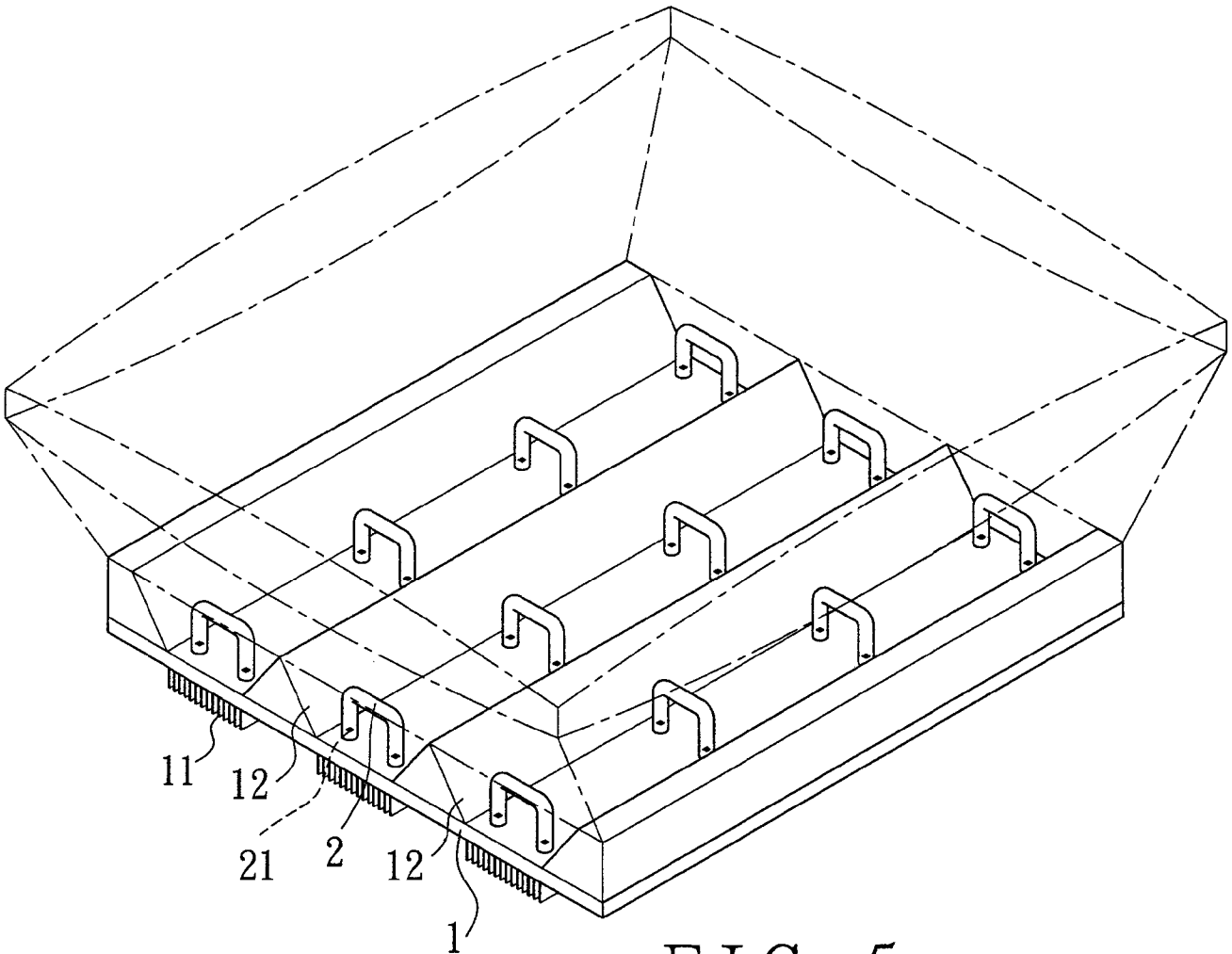
FIG. 5 is a schematic view showing still another embodiment of the light emitting unit of the present invention.

As shown in FIG. 5, a still another embodiment of the present invention has a lamp holder (1) made of insulating ceramics with high thermal conductivity. A multiple sets of light-transmissive lamp tubes (2), in which each set contains a plurality of light-transmissive lamp tubes (2) and its corresponding light sources (21), are arranged on the lamp holder (1). A reflecting member (12) is provided at both sides with respect to each set of the light-transmissive lamp tube (2) and the light source (21). Similarly, a lampshade (3) is provided on the lamp holder (3) and a light-transmitting member (4) is provided at the outside the lampshade (3) with respect to the light-transmissive lamp tube (2). This embodiment is also to cope with the case of different application.

Based on foregoing, the light emitting unit of this invention mainly comprises: a lamp holder made of insulating ceramics with high thermal conductivity; a plurality of heat dissipating fins protruding integrally from the outer end face of the lamp holder; a lampshade having a light reflecting surface in the inner edge being provided on the lamp holder with respect to the light-transmissive lamp tube; and a light-transmitting member provided at the outside of the lampshade with respect to the transmissive lamp tube. Comparing with the conventional light emitting unit, better illumination effect can be obtained from the entire light emitting unit. Moreover, significant heat dissipation effect can also be achieved by the lamp holder made of insulating ceramics with high thermal conductivity and the heat dissipating fins formed integrally with the lamp holder, such that the reduced service lifetime, light depreciation and burn-down of the inside light source caused by overheating can be avoided so as to increase the entire performance in use.

While the present invention has been described with preferred embodiments in conjunction with the accompanying drawings, it is noted that the preferred embodiments and the drawings are purely for the convenience of description only, not intended to be restrictive on the scope of the present invention. Any modifications and variations or the equivalents brought out without departing from the spirit of the present invention is considered to be still within the scope of the present invention.

What is claimed is:

1. A light emitting unit, mainly comprising:

a lamp holder (1) made of insulating ceramics with high thermal conductivity;

a plurality of heat dissipating fins (11) made of insulating ceramics with high thermal conductivity protruding integrally from the outer end face of the lamp holder (1);

a light-transmissive lamp tube (2) provided on the lamp holder (1);

a light source (21) mounted in the light-transmissive lamp tube (2);

a lampshade (3) provided on the lamp holder with respect to the outer edge of the light-transmissive lamp tube (2); and a light-transmitting member (4) provided at the outer end of the lampshade (3) with respect to the light-transmissive lamp tube (2).

2. A light emitting unit according to claim 1, wherein the light source (21) provided within the light-transmissive lamp tube (2) is a light emitting diode (LED).

3. A light emitting unit according to claim 1, wherein the light source (21) provided within the light-transmissive lamp tube (2) is a mercury vapor lamp.

4. A light emitting unit according to claim 1, wherein a reflecting surface is provided on the inner edge of the lampshade (3).

5. A light emitting unit according to claim 1, wherein the light-transmitting member (4) is coated with a fluorescent material (41).

6. A light emitting unit according to claim 1, wherein a convex transmissible surface (42) is formed on the middle position of the light-transmitting member (4).

7. A light emitting unit according to claim 1, wherein the lamp holder (1) is provided thereon with one set of a light-transmissive lamp tube (2), a light source (21), a lampshade (3) and a light-transmitting member (4).

8. A light emitting unit according to claim 1, wherein the lamp holder (1) is provided thereon with multiple sets of light-transmissive lamp tubes (2) and the corresponding light sources (21), and then a lampshade (3) is provided on the lamp holder (3) and a light-transmitting member (4) is provided at the outer end of the lampshade correspondingly.

9. A light emitting unit according to claim 1, wherein a reflecting member (12) is provided at both sides with respect to each set of light-transmissive lamp tube (2) and light source (21).

* * * * *